US005263999A

United States Patent [19]

Baldwin et al.

[11] Patent Number: 5,263,999

[45] Date of Patent: Nov. 23, 1993

[54] SMOKING ARTICLE WRAPPER FOR CONTROLLING BURN RATE AND METHOD FOR MAKING SAME

[75] Inventors: Sheryl D. Baldwin; Navin Gautam, both of Richmond; Kenneth S. Houghton, Midlothian; Robert M. Rogers, Richmond; Judith L. Ryder, Deltaville, all of Va.

[73] Assignee: Philip Morris Incorporated, New York, N.Y.

[21] Appl. No.: 757,243

[22] Filed: Sep. 10, 1991

[51] Int. Cl.[5] ..... A24D 1/02

[52] U.S. Cl. ..... 131/365; 131/349

[58] Field of Search ..... 131/365, 349, 384, 351, 131/358, 372, 373; 162/139

[56] References Cited

U.S. PATENT DOCUMENTS

| | | | |
|---|---|---|---|
| 3,915,176 | 10/1975 | Heitmann et al. | 131/84.4 X |
| 4,239,591 | 12/1980 | Blake | 162/109 |
| 4,361,156 | 11/1982 | Hall | 131/37 X |
| 4,861,427 | 8/1989 | Johnson et al. . | |
| 4,952,278 | 8/1990 | Gregory et al. . | |
| 5,074,321 | 12/1991 | Gentry et al. . | |

*Primary Examiner*—V. Millin
*Assistant Examiner*—J. Doyle
*Attorney, Agent, or Firm*—David C. Radulescu; Marta E. Gross

[57] ABSTRACT

This invention relates to the control of the burn rate of a cigarette. The burn rate is controlled by the use of a paper wrapper to which regions of cellulosic material is applied and bonded. The cellulosic material is applied during a manufacturing step for the base paper wrapper, either off or on-line of the paper wrapper-forming machine.

15 Claims, No Drawings

SMOKING ARTICLE WRAPPER FOR CONTROLLING BURN RATE AND METHOD FOR MAKING SAME

BACKGROUND OF THE INVENTION

The present invention relates to a paper wrapper construction for use in conjunction with a smoking article, such as a cigarette. Specifically the paper wrapper of this invention can be used to effectively control the burn rate of the smoking article. The paper wrapper of the present invention comprises cellulosic material which is applied to regions of a base paper web.

It is beneficial to make cigarettes in commercial quantities which will have a reduced burn rate if not drawn on by the smoker but which look, feel, taste and burn like conventional cigarettes when being drawn on by the smoker at normal intervals. It is recognized by those skilled in the art that the wrapper configuration and construction strongly influences these characteristics.

Cigarette wrappers, i.e., papers, have known burn characteristics, including burn rates and static burn capabilities. There have been various attempts to modify the burn characteristics of such wrappers. These attempts have employed a variety of wrapper configurations and constructions.

For example, it is known that the burn characteristics can be modified by adding fillers, coatings, or additives to the papers. Weinert U.S. Pat. No. 4,489,650 refers to a self-extinguishing cigarette in which the interior surface of the wrapper is coated with clay. In Cohn U.S. Pat. No. 4,044,778, the cigarette wrapper referred to includes rings or areas coated with deposits from an alkali silicate solution which renders the wrapper non-burning in the coated areas.

In Adams et al. U.S. Pat. No. 4,889,145, the cigarette wrapper referred to includes an area containing a coating of a porosity reducing composition. The coating is comprised of a non-polymer with a polymer binder. Examples of the non-polymer were given as a fatty alcohol and a fatty acid salt.

Durocher U.S. Pat. No. 4,615,345 refers to another attempt to modify the burn characteristics of wrappers. In Durocher the wrapper is made of a cellulose fiber base which normally does not sustain burning when the wrapper is incorporated into a cigarette. This type of wrapper is treated in selected zones with an alkali metal burn promoter such as the potassium salt of citric acid. It is referred to therein that a cigarette made with a wrapper so treated will smolder without being drawn on by the smoker when in the treated zone but when the treated zone is consumed will extinguish itself unless the cigarette is drawn on by the smoker.

Baker et al. U.S. Pat. No. 4,077,414 also refers to a wrapper with modified burn characteristics. In Baker, a wrapper with inherently high porosity is modified by treating the paper with what was referred to as a "gel-forming" substance so as to produce bands of low porosity regions. The "gel-forming" substances disclosed in Baker were all soluble in water and thus were solutions, as opposed to slurries, when applied to the cigarette paper wrapper.

In addition to modifying wrapper burn characteristics by adding fillers, coatings or burn additives directly to the base paper web, burn characteristics have been shown to be able to be modified by applying to the base paper web a strip or patch of a paper having different characteristics than the base web to be modified. For example, it is shown in co-pending, commonly-assigned U.S. patent application Ser. No. 07/605,402, filed Oct. 30, 1990, that cigarette paper can be modified by applying strips of a different paper at periodically spaced positions across the width of the paper web, so that cigarettes produced from the paper web have periodically spaced circumferential bands on the inside of the paper for modifying the burning characteristics of the paper and the cigarette. One treated paper material suitable for forming the periodically spaced strips is described in Hampl U.S. Pat. No. 4,739,775. However, the wrappers discussed in Hampl were formed by the adhesion of the treated paper material to the base paper web by a process which would be difficult and costly to use for mass production.

As discussed above, various types of cigarette wrapper configurations have been proposed for modifying the burn characteristics of cigarettes. However, these wrappers have various problems and disadvantages. Although the wrappers of Weinert and Cohn produce cigarettes with modified burn characteristics, they do not look, feel, taste and burn like conventional cigarettes when being drawn on by the smoker. Although the wrappers of Durocher solve some of the problems exhibited by the Weinert and Cohn wrappers, Durocher did not disclose a process for making such cigarette wrappers in commercial quantities. In addition, although co-pending application Ser. No. 07/605,402 discloses commercially feasible methods that can produce wrappers with both modified burn characteristics and that look, feel, taste and burn like a conventional cigarette when being drawn on by the smoker, such methods are not the only solutions to the problems discussed. Additionally, the wrappers and coatings referred to in Baker et al. and Adams et al. are not the only types that can potentially modify the burn rate of a cigarette.

Johnson U.S. Pat. No. 4,861,427 refers to a fibrous web product with bacterial cellulose as a surface treatment. In Johnson the bacterial cellulose treatment referred to is applied to the entire web. The resulting coating web is used as printing materials which have gloss, smoothness, ink receptivity and surface strength.

Johnson does not refer to the application of the cellulose to papers in selected portions of the web, i.e., in bands or other patterns, nor does Johnson refer to burn control properties that such an application of bacterial cellulose will impart to the resulting paper. Johnson does not disclose the use of the coated web for cigarette paper.

It would be desirable to provide a paper wrapper for a smoking article that effectively controls the burn rate of the smoking article.

It would also be desirable to provide a paper wrapper for a smoking article that looks, feels, tastes and burns like a conventional cigarette when being drawn on by the smoker.

It would further be desirable to provide a paper wrapper in which burn rate control can be achieved economically with mass-production techniques.

SUMMARY OF THE INVENTION

It is an object of this invention to provide a paper wrapper for a smoking article that can modify the burn characteristics of the smoking article.

It is also an object of this invention to provide such wrappers that, when used to make cigarettes, provides a cigarette with the further advantage of looking, feeling, tasting and burning like a conventional cigarette when being drawn on by the smoker at normal intervals.

It is also an object of this invention to provide a paper wrapper in which a banded area for controlling burn rate can be applied during manufacture of the base paper wrapper, either off or on-line of the paper machine, but beyond the wet end of the paper machine.

Furthermore, it is an object of this invention to provide a banded paper wrapper that can be manufactured in commercial quantities and in conjunction with commercial cigarette making operations with out the need for non-conventional apparatuses.

In accordance with the present invention, there is provided a paper wrapper for a smoking article comprising a paper base web with one or more regions of fibrous cellulose applied and bonded to the paper base web. The fibrous cellulose can be selected from the group consisting of microcrystalline cellulose, bacterial cellulose and microfibrillated cellulose as well as other new forms of fibrous cellulose capable of forming a stable suspension in liquid and thus capable of being printer or coated onto a base paper web. This paper wrapper can be incorporated into a smoking article comprising a tobacco filler and said paper wrapper.

In addition, a method for making the smoking article wrapper is also provided. This method comprises the steps of advancing the base paper web of the wrapper along a travel path which passes through a fibrous cellulose-applying step and applying cellulosic material to said base paper web at said fibrous cellulose-applying position so as to form one or more regions of fibrous cellulose. The fibrous cellulose-applying position can comprise applying a slurry of cellulosic material and water to the said base paper web and thus form the smoking article wrapper.

The paper wrapper of this invention may be used for cigarettes of any length or circumference and having different fillers, such as tobacco, expanded tobacco, a variety of tobacco blend types, reconstituted tobacco materials, non-tobacco filler materials and combinations thereof.

DETAILED DESCRIPTION OF THE INVENTION

Paper consists of a web of cellulosic fibers held together by hydrogen bonding. A paper web without an inorganic filler such as calcium carbonate is non-porous and either does not burn or burns very slowly. The calcium carbonate, or other inorganic filler, present in cigarette paper disrupts the fiber bonding and opens the structure of the paper to allow the entry of air to support combustion. The invention disclosed herein consists of the application of additional cellulose fibers, fibrils or microfibrils onto the surface of a base paper web in order to modify and tailor the burn characteristics of the resulting paper web. When such a paper web is incorporated into the wrapper of a smoking article, the burn characteristics of the resulting smoking article are also modified.

As used herein, the term "fibrous cellulose" is defined to mean cellulose in the form of either fibers, fibrils or microfibrils, or any combination thereof in various states of subdivision. "Fibrils" are the threadlike elements of the wall of the cellulose fiber visible with an optical microscope. Upon examination by electron microscopy "fibrils" are found to consist of still finer "microfibrils."

The base paper web of the present invention is a conventional cigarette paper onto which is applied a slurry of fibrous cellulose (i.e., fibers, fibrils, or microfibrils, or any combination thereof in various states of subdivision). A main advantage of the present invention is that the fibrous cellulose can be applied by means of various conventional coating or printing techniques. Furthermore, the fibers, fibrils or microfibrils can be applied on-line or off-line of the base paper making apparatus beyond the wet end of the paper machine. As a result of the above advantages, smoking articles incorporating the wrappers disclosed herein can be mass produced.

A unique aspect of the present invention is that the application of the slurry of fibrous cellulose under the processes disclosed herein results in a dense mat of fibers, fibrils or microfibrils present on the surface of the base paper web as revealed by scanning electron microscopy studies. It is believed that the dense mat of fibrous cellulose which contains no inorganic filler or added burn chemicals, provides a region which slows combustion. The dense mat of fibrous cellulose then can be used to control the burn rate of a cigarette. A smoking article incorporating a wrapper with the dense mat of fibrous cellulose of the present invention can thus have simplified burn rate control. Burn rate control can be modified or tailored to the extent desired by optimizing the application level of the fibrous cellulose or the width and spacing of the regions or bands of the dense mat of fibrous cellulose.

The cigarette with which the paper wrapper of this invention may be used may be of any length or circumference. Preferably, the circumference of the cigarette may be in the range from about 15 millimeters to about 28 millimeters. In addition, the cigarettes with which the paper wrapper of this invention may be used may contain various fillers such as tobacco, expanded tobacco, a variety of tobacco blend types, reconstituted tobacco materials, non-tobacco filler materials and combinations thereof.

The paper wrappers of this invention may be made from flax or other cellulosic fibers, such as wood pulp or esparto, and an inorganic filler, typically calcium carbonate, with a loading of between about 20 percent by weight and about 40 percent by weight. Other suitable conventional mineral fillers, or a combination of fillers, may be used such as the various phases of calcium or magnesium carbonates, or the like, along with hydroxides of magnesium or the like. Burn additives such as citrates, phosphates, succinates or the like may also be used in the paper wrappers.

Cigarette papers in use cover a wide range in porosity and burn rate. The inherent porosity of the paper varies from about 2 to about 150 Coresta units. Papers with lower values for inherent porosity require less added fibrous cellulose in the banded region to control the burn rate than papers with higher values. Therefore simple experimentation will be required to adjust the level of slurry applied to the base paper based on the type of base paper used and the desired burn characteristics. Preferably, the base paper should have a basis weight of about 25 to about 30 g/m$^2$; the inherent porosity should be in the range from about 20 to about 60 Corresta units; the calcium carbonate concentration should be in the range from about 25 to about 37 percent; and the citrate concentration should in the range from about 0.5 to about 3 percent. In the Examples discussed below, the base paper (referred to as "conventional cigarette wrapper") had the following characteristics unless specifically stated otherwise: basis weight of about 25 g/m$^2$, inherent porosity in the range from about 25 to about 30 Corresta units, calcium carbonate concentration in the range from about 25 to about 30 percent and citrate concentration in the range from about 0.5 to about 3 percent.

The addition of a fibrous cellulose to form regions or bands in the paper wrapper has been found to affect the burn rate of the resulting cigarette. A slurry of the fibrous cellulose is applied to the paper wrapper, in the desired locations and patterns, during or after the initial manufacturing of the base paper wrapper. If the slurry is applied during the initial manufacturing, this step should preferably be performed beyond the wet end of the base paper making apparatus.

Any cellulose material capable of forming a suspension in a liquid which is sufficiently stable for coating or printing may be used. Preferably, the cellulose material is suspended in water, thus forming a stable slurry since cellulose is insoluble in water. A first preferred cellulosic material is microcrystalline cellulose. Most preferably, it is a microcrystalline cellulose in combination with a binder to form a colloidal suspension of cellulose and binder. Such a preferred cellulosic material is AVICEL TM CL-611 cellulose available from the FMC Corporation of Philadelphia, Pennsylvania. AVICEL TM CL-611 is a colloidal dispersion of microcrystalline cellulose co-processed with sodium carboxymethyl cellulose (about 10 to about 15% by weight). A second preferred cellulosic material is a bacterial cellulose material. Such a preferred bacterial cellulose is CELLULON TM available from the Weyerhaeuser Company of Tacoma, Washington. CELLULON TM fiber is available in the solid composition form of from about 15 to about 20 wt. % of bacterial cellulose and about 79 to about 85 wt. % water. A third cellulosic material capable of forming a stable suspension is Buckeye TM Expanded Fibers, which is a highly refined and fibrillated cellulose made using mechanical abrasion and supplied by Proctor and Gamble Co. of Cincinnati, Ohio. A fourth cellulosic material capable of forming a stable suspension is the new form of microcrystalline cellulose FIRBROCELL TM developed and sold by Resources Industries Inc. (Emerson, New Jersey).

In addition to the specific types of cellulosic material disclosed in the preceding paragraph, this invention contemplates that there are other novel forms of cellulosic material that are capable of forming a stable suspension in liquid and thus capable of being able to be incorporated into the smoking article wrappers of the present invention. The only requirement on the cellulosic material is that it must be able to form a sufficiently stable suspension in a liquid so that the suspension can be printed or coated onto the base paper web of the present invention.

The ability of the cellulosic material of the present invention to form a stable suspension is a unique feature of this invention. If the cellulosic material is not capable of forming a stable suspension in liquid then the cellulosic material will either "settle out" of solution or "dissolve" into solution. Excessive "settling" of the fibrous cellulose would destroy the potential to print or coat cellulose in the fibrous form onto a base paper web as disclosed in the present invention. It should be noted that the materials disclosed herein generally do require considerable agitation to maintain the suspension and are not permanently stable as is a solution or a true gel, but they are intermediate in character compared to those materials and to totally heterogeneous slurries.

If the fibrous cellulose "settles out" of solution, then the fibrous cellulose will collect at the bottom of the mixing apparatus or will plug orifices of spray/application devices and thus would be incapable of being printed or coated onto a base paper web using conventional printing or coating techniques, which is a unique aspect of the present invention. Furthermore, even if this first printing/coating problem were surmounted then a second problem would still exist. This later problem is a result of the fact that adhesion of the fibrous cellulose to the base paper web would be difficult without the addition of a binding material to the fibrous cellulose. This is a result of the fact that a key feature of the present invention is that the fibrous celluloses disclosed herein are capable of bonding, with or without the addition of a binding material, to an underlying base paper web. Such bonding (generally hydrogen bonding) is possible because of the high surface area or the high degree of refining of the fibrous cellulose materials disclosed herein compared to that of conventional paper making fibers. Because of these characteristics they are inherently capable of hydrating extensively and thus are able to form more stable suspensions in water than are conventional paper making fibers. The ability of the cellulose materials contemplated by this invention to hydrate extensively is believed to be related to the increase in surface area of cellulose when cellulose fibers undergo refining or other processes. Refinement creates a high degree of fibrillation and/or exposes microfibrils along the cellulose fiber and thus results in an increase in surface area. It is believed that this increase in surface area creates more sites for hydration of the fibers in the slurry or suspension and thus increases the swelling of the fibers which augments the stabilization of the slurry or suspension and thus allows the fibrous cellulose to adhere to an underlying base paper web. The adhesion of the refined fibrous cellulose to an underlying base paper web allows regions of burn rate altering material to be formed on a smoking article wrapper. A desirable feature of this burn altering region is that it does not include any material that is foreign to the base paper web: it only includes fibrous cellulose with or without binder.

If the fibrous cellulose material does form a sufficiently stable suspension in liquid (i.e., does not "settle out" rapidly) then the suspension will be able to be coated or printed on to a base paper web and form regions of fibrous cellulose capable of altering and tailoring the burn rate of a smoking article. Because of the increase in surface area of refined cellulose materials there are more sites for hydrogen bonding to take place, and thus more sites for adhesion to occur to an underlying base paper web without or with minimal need for a binder. In summary, any new or novel fibrous cellulosic material that exhibits the properties discussed herein is capable of being incorporated into the smoking article of this invention.

Homogenization of the cellulosic material prior to slurry make-up has been found to enhance the rheological properties of the slurry and therefore allows for a greater flexibility in slurry application techniques. Binders which may be used with the cellulosic material are carboxymethyl cellulose (CMC), hydroxypropyl cellulose, starch, guar, or various other polysaccharide binders or the like. Preferably, the binder is CMC or hydroxypropyl cellulose.

A slurry of the cellulosic material is made by first mixing the cellulose with water. The concentration of solid added to the water is between about 0.5 wt. % and about 10 wt. %, depending upon the specific type of cellulosic material. For example, for CELLULON TM the preferred concentration is between about 0.5 wt. % and about 1.5 wt. %, while for AVICEL TM CL-611 the preferred concentration is between about 5 wt. % and 10 wt. %. The desired concentration of solid cellulosic material which should be added to the water is also dependant upon the particular slurry application process used, as would be expected to one of ordinary skill in the art.

The addition of a binder material to the slurry causes the slurry to exhibit improved rheological properties and therefore allows for a greater range of application techniques to be employed, such as conventional paper coating or printing techniques, i.e., gravure or flexigraphic coating, or other suitable coating or printing techniques.

If the cellulosic material was not coprocessed with a binder during its manufacturing process, then binder can be added to the slurry. If the cellulosic material was co-processed with a binder during manufacture, as is the case for AVICEL TM CL-611 which contains approximately 10–15% by weight CMC, then adding binder to the slurry may not be necessary to achieve the desired rheological properties for application of the slurry to the base paper web. The total amount of binder present in the slurry should be in the range from about 0.1% to about 10%, by weight. Preferably, the amount of binder present should be in the range from about 0.5% to about 2%, by weight.

The binder may be omitted from the slurry for some cellulosic materials, if desired, and the cellulosic slurry can then be applied to the paper by techniques such as a spraying operation or extrusion-type process such as those used in the application of hot melt materials. Although the application options are more limited when the binder is omitted from the cellulosic slurry, the advantages to omitting it are that the taste of the smoking article may be improved and that one less processing step is required for fabrication of the smoking article wrapper.

After the cellulosic slurry is formed, either with or without binder, it is then applied to the base paper web by the processes discusses herein. After the slurry is applied to the base paper web, the slurry can be dried using a drum dryer or infrared heater, or the like, as in conventional paper manufacturing. Typically between about 10 g/m$^2$ and about 200 g/m$^2$ wet weight of the cellulosic slurry is applied to the paper to result in dry weight of cellulosic material of between about 0.5 g/m$^2$ and about 10 g/m$^2$. The preferred wet weight is dependant upon the particular type and concentration of cellulosic slurry employed. For example, for a slurry with about 1.0% CELLULON TM, one will need about 1 g/m$^2$ wet weight to result in a dry weight of about 1 g/m$^2$; whereas for a slurry with about 6% AVICEL TM CL-611, one will need about 17 g/m$^2$ to result in a dry weight of about 1 g/m$^2$.

The cellulosic slurry may be applied to form bands at any desired interval and width depending on the particular desired burn control rate. Preferably, bands are applied at intervals of about 10 mm to about 25 mm. The width of the band may be varied depending on the type of cigarette and paper used in addition to the type and level of slurry applied. Preferably the width of the band is about 5 mm to about 10 mm.

The following Examples serve to illustrate the preparation and application of the cellulosic slurry to the base paper.

EXAMPLES

Example 1

A slurry of CELLULON TM containing 0.5% of solids was applied to a conventional cigarette wrapper using a plastic template and draw-down rod coating method. The template used in this example had 5 mm wide open areas that were spaced 21 mm apart. The template was laid over the cigarette wrapper in such a way that the template's open areas were parallel to the cross-direction of the wrapper. The CELLULON TM slurry is poured on to the plastic template and then applied by a lab scale draw-down rod coater (the rod moves in a direction parallel to the template's open areas). The slurry was then applied onto the cigarette wrapper through the open areas of the template and, after drying, appear as cross-directional bands of CELLULON TM. The add-on level in the band areas was approximately 1.0 g/m$^2$ on top of 25 g/m$^2$ base sheet (i.e., the band areas had a basis weight of 26 g/m$^2$ while the non-band areas had a basis weight of only 25 g/m$^2$). Cigarettes were hand-made (diameter of 24.8 mm) using the wrapper described above and a conventional tobacco blend. The cigarettes showed a reduction of the static burn rate in the regions of the band.

Example 2

A slurry of CELLULON TM containing 0.9% solids was applied to a conventional cigarette wrapper using the method described above in Example 1. The add-on level in the banded areas was approximately 2.0 g/m$^2$ on top of a 25 g/m$^2$ base sheet (i.e., the band areas had a basis weight of 27 g/m$^2$ while the non-band areas had a basis weight of only 25 g/m$^2$). Cigarettes were hand-made using the wrapper described above and a conventional tobacco blend. The cigarettes showed a reduction of the static burn rate in the regions of the band.

Example 3

A slurry of BUCKEYE TM Expanded Fibers containing 2.3% solids was applied to a conventional cigarette wrapper using the method described above in Example 1. The add-on level in the band areas was approximately 7.0 g/m$^2$ on top of a 25 g/m$^2$ base sheet (i.e., the band areas had a basis weight of 32 g/m$^2$ while the non-band areas had a basis weight of only 25 g/m$^2$). Cigarettes were hand-made using the wrapper described above and a conventional tobacco blend. The cigarettes showed a reduction of the static burn rate in the regions of the band.

Example 4

A slurry of AVICEL TM CL-611 containing 5.0% solids was applied to a conventional cigarette wrapper using the method described in Example 1. The add-on level in the band areas was approximately 3.5 g/m$^2$ on top of a 25 g/m$^2$ base sheet (i.e., the band areas had a basis weight of 28.5 g/m$^2$ while the non-band areas had a basis weight of only 25 g/m$^2$). Cigarettes were hand-made using the wrapper described above and a conventional tobacco blend. The cigarettes showed a reduction of the static burn rate in the regions of the band.

Example 5

A slurry of AVICEL TM CL-611 containing 8.0% solids was applied to a conventional cigarette wrapper using a gravure roll. The cross-directional bands of AVICEL TM cellulose after application by the gravure roll were approximately 7 mm wide. The add-on level was approximately 1.5 g/m$^2$ on top of a 25 g/m$^2$ (i.e., the band areas had a basis weight of 26.5 g/m$^2$ while the non-band areas had a basis weight of only 25 g/m$^2$). Machine-made cigarettes were made using the wrapper described above and a conventional tobacco blend. The cigarettes showed a reduction of the static burn rate in the regions of the band.

Example 6

A slurry of AVICEL TM CL-611 containing 4.0% solids was applied to a conventional cigarette wrapper using a soft rubber covered grooved roll at the size-press. The soft rubber covered roll had 3.2 mm wide and 0.18 mm deep grooves. The paper passes between the grooved roll and a plain roll. The grooves were filled with the AVICEL TM slurry and the excess was removed by a doctoring blade. The AVICEL TM was transferred onto the paper at the size-press nip and dried using can driers. The bands of AVICEL TM on paper were approximately 5 mm wide. The add-on level in the band areas was less than 2 g/m$^2$ on top of 25 g/m$^2$ base sheet. The actual application levels in the band were not determined for these samples due to the limited supply of samples. Machine-made cigarettes were made using the wrapper described above and a conventional tobacco blend. The cigarettes showed a reduction of the static burn rate in the regions of the band.

Example 7

A slurry of AVICEL TM CL-611 containing 10% solids was applied to a high basis weight cigarette wrapper (45 g/m$^2$, 8 Coresta) using a modified gravure roller.

The roller was smooth except for 10 mm wide (measured around perimeter of the roller) and 55.5 mm long (measured along the axis of the roller) grooves which were 0.5 mm deep. These grooves were spaced 31.9 mm apart, centerline to centerline around the roller. A rubber covered pressure roller was pressed against the grooved roller. The 4-inch wide paper was fed onto the grooved roller before the nip point. The grooves were filled with slurry which was then transferred to the paper. The depth of the roller groove, concentration of slurry, and release characteristics of the roller all affected the thickness of the material deposited onto the paper, as would be expected to one of ordinary skill in the art.

The add-on level in the band area was approximately 5.8 g/m$^2$ on top of the 45 g/m$^2$ base sheet. Handmade cigarettes were made with the above described wrapper and a conventional tobacco blend. The cigarettes showed a reduction of the static burn rate in the regions of the band.

Example 8

Three different slurries of AVICEL TM CL-611 containing three different concentrations of solid were applied to a conventional cigarette wrapper using a gravure roll. The cross-directional bands of AVICEL TM cellulose after application were approximately 7 mm wide. The add-on levels were approximately 1 g/m$^2$, 1.5 g/m$^2$, and 2.0 g/m$^2$ on top of the 25 g/m$^2$ base paper, so that the banded areas had a basis weight of approximately 26 g/m$^2$, 26.5 g/m$^2$, 27 g/m$^2$, while the non-banded areas were only 25 g/m$^2$. Machine-made cigarettes using the above-described wrapper and conventional tobacco blend were analyzed for burn rate in the static mode. The cigarettes showed a reduction of the static burn rate in the regions of the band. The degree of burn rate reduction achieved was dependent on the application level of the AVICEL TM.

Example 9

Machine made cigarettes were prepared from 25 g/m$^2$ basis weight, 30 Coresta porosity papers to which KLUCEL TM (hydroxypropyl cellulose from Aqualon Company, Wilmington, Delaware) was applied to the surface of the paper using a solution of about 6–8 percent in water. This resulted in a film application level of about 2.5 g/m$^2$. The solution of KLUCEL TM was applied by gravure printing techniques in 7 mm wide bands. The cigarettes so produced showed no reduction of the static burn rate in the regions of the band.

It should be noted that the "film former" KLUCEL TM (hydroxypropl cellulose) is a water soluble thermoplastic polymer. Because KLUCEL TM is soluble in water, it forms a solution and not a slurry. As such, it produces a film on the surface of the base paper web, as shown by microscopic analysis, as opposed to the fibrous mats formed by the slurries of this invention.

One skilled in the art will appreciate that the present invention can be practiced by other than the described embodiments, which are presented for purposes of illustration and not of limitation, and the present invention is limited only by the claims that follow.

What is claimed is:

1. A paper wrapper for a smoking article comprising a paper base web with one or more regions of fibrous cellulose applied and bonded to the paper base web, wherein the fibrous cellulose is selected from the group consisting of microcystalline cellulose, bacterial cellulose and microfibrillated cellulose, and wherein the regions of fibrous cellulose comprise between about 0.5 g/m$^2$ and about 10 g/m$^2$ (dry weight) on top of the base paper.

2. The paper wrapper of claim 1 wherein the regions of fibrous cellulose include a binder.

3. The paper wrapper of claim 1 wherein the regions of fibrous cellulose include a binder and the binder is selected from the group consisting of carboxymethyl cellulose, hydroxypropyl cellulose, starch and guar.

4. The paper wrapper of claim 1, wherein the regions of fibrous cellulose comprise between about 0.5 g/m$^2$ and about 7 g/m$^2$ (dry weight) on top of the paper base web.

5. The paper wrapper of claim 4, wherein the regions of fibrous cellulose comprise between about 0.5 g/m$^2$ and about 5.8 g/m$^2$ (dry weight) on top of the paper base.

6. The paper wrapper of claim 5, wherein the regions of fibrous cellulose comprise between about 0.5 g/m$^2$ and about 3.5 g/m$^2$ (dry weight) on top of the paper base web.

7. The paper wrapper of claim 6, wherein the regions of fibrous cellulose comprise between about 0.5 g/m$^2$ and about 2.0 g/m$^2$ (dry weight) on top of the paper base web.

8. A method for making a smoking article paper wrapper comprising a base paper web with one or more regions of fibrous cellulose, said method comprising the steps of:

a) advancing the base paper web along a travel path which passes through a fibrous cellulose-applying position; and b) applying cellulosic material to said base paper web at said fibrous cellulose-applying position so as to form one or more regions of fibrous cellulose, wherein the fibrous cellulose-applying step b) further comprises applying to said base paper web a slurry of from about 0.5 wt. % to about 1.5 wt. % solids in water, wherein said solids comprise bacterial cellulose.

9. A method for making a smoking article paper wrapper comprising a base paper web with one or more regions of fibrous cellulose, said method comprising the steps of:

a) advancing the base paper web along a travel path which passes through a fibrous cellulose-applying position; and b) applying cellulosic material to said base paper web at said fibrous cellulose-applying position so as to form one or more regions of fibrous cellulose, wherein the fibrous cellulose-applying step b) further comprises applying to said base paper web a slurry of from about 5 wt. % to about 10 wt. % solids in water, wherein said solids comprise a composition of microcrystalline cellulose with binder.

10. A paper wrapper for a smoking article comprising a paper base web with one or more regions of a mat of fibrous cellulose bonded to the surface of the web, wherein the regions of fibrous cellulose are obtained by applying a slurry of fibrous cellulose to the paper base web, wherein the slurry is selected from the group consisting of microcrystalline cellulose, bacterial cellulose and microfibrillated cellulose, and wherein the regions of fibrous cellulose comprise between about 0.5 $g/m^2$ and about 10 $g/m^2$ (dry weight) on top of the base paper.

11. A smoking article comprising a tobacco filler and a paper wrapper wherein the paper wrapper comprises a paper base web with one or more regions of fibrous cellulose applied and bonded to the base paper web, wherein the fibrous cellulose is selected from the group consisting of microcrystalline cellulose, bacterial cellulose and microfibrillated cellulose, and wherein the regions of fibrous cellulose comprise between about 0.5 $g/m^2$ and about 10 $g/m^2$ (dry weight) on top of the base paper.

12. The smoking article of claim 11, wherein the regions of fibrous cellulose include a binder.

13. The smoking article of claim 12 wherein the binder is selected from the group consisting of carboxymethyl cellulose, hydroxypropyl cellulose, starch and guar.

14. A paper wrapper for a smoking article comprising a paper base web with one or more regions of fibrous cellulose applied and bonded to the paper base web, wherein the regions of fibrous cellulose comprise between about 0.5 $g/m^2$ and about 10 $g/m^2$ (dry weight) on top of the base paper.

15. A paper wrapper for a smoking article comprising a paper base web with one or more regions of a mat of fibrous cellulose bonded to the surface of the web, wherein the regions of fibrous cellulose are obtained by applying a slurry of fibrous cellulose to the paper base web, wherein the regions of fibrous cellulose comprise between about 0.5 $g/m^2$ and about 10 $g/m^2$ (dry weight) on top of the base paper.

* * * * *